United States Patent [19]

Armand

[11] 4,392,924

[45] Jul. 12, 1983

[54] PROCESS FOR CONTROLLING THE PERMEABILITY OF DIAPHRAGMS IN THE PREPARATION OF POLYVALENT METALS BY ELECTROLYSIS AND AN ELECTROLYSIS CELL FOR CARRYING OUT THE PROCESS

[75] Inventor: Marcel Armand, Meylan, France

[73] Assignee: Pechiney Ugine Kuhlmann, Paris, France

[21] Appl. No.: 313,229

[22] Filed: Oct. 20, 1981

[30] Foreign Application Priority Data

Nov. 27, 1980 [FR] France ..... 80 25504

[51] Int. Cl.[3] ..... C25C 3/26; C25C 3/28; C25C 3/34; C25C 7/06

[52] U.S. Cl. ..... 204/64 T; 204/61 R; 204/246; 204/247

[58] Field of Search ..... 204/64 T, 64 R, 246, 204/247, 231

[56] References Cited

U.S. PATENT DOCUMENTS 2,789,943 4/1957 Kittelberger ..... 204/64 T

OTHER PUBLICATIONS

Ion-Selective Electrodes, Proceedings of a Symposium held at the Nat'l. Bureau of Standards, Jan. 1969, (p. 368, Issued Nov. 1969).

*Primary Examiner*—Howard S. Williams

*Attorney, Agent, or Firm*—Dennison, Meserole, Pollack & Scheiner

[57] ABSTRACT

The process according to the invention concerns the production of polyvalent metals such as titanium by electrolysis of molten halides.

It comprises controlling the permeability of the diaphragm which separates the anolyte from the catholyte, by causing growth or re-dissolution of a deposit of the metal to be produced.

The process is applied in particular to the production of titanium by electrolysis from $TiCl_4$.

5 Claims, 3 Drawing Figures

Figure 1:
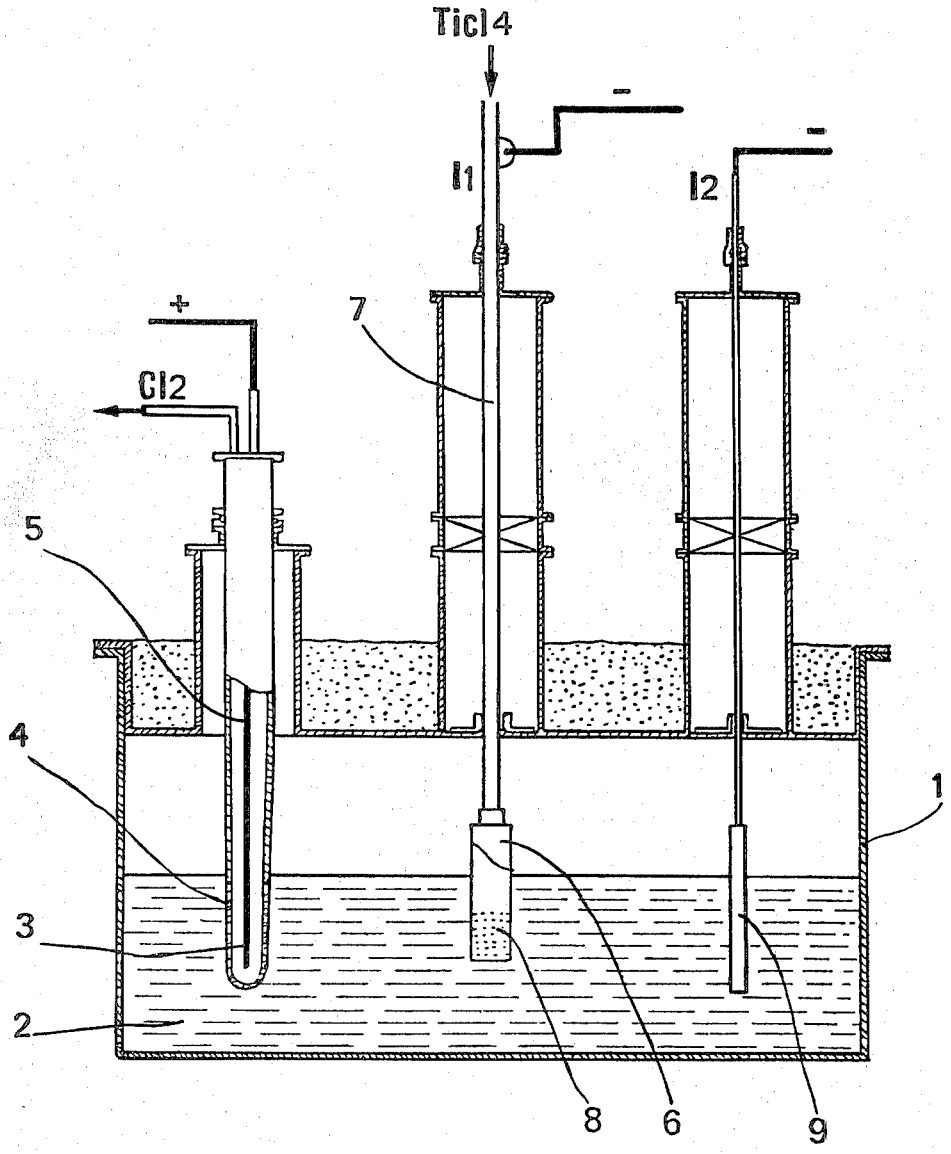

PROCESS FOR CONTROLLING THE PERMEABILITY OF DIAPHRAGMS IN THE PREPARATION OF POLYVALENT METALS BY ELECTROLYSIS AND AN ELECTROLYSIS CELL FOR CARRYING OUT THE PROCESS

The process which is the subject of this invention concerns the preparation of polyvalent metals such as titanium, zirconium, hafnium, vanadium, niobium or tantalum by electrolysis in baths of molten salts of halides thereof dissolved in one or more alkali or alkaline earth halides.

The process is applied more particularly to the preparation of titanium by the electrolysis of a bath of molten halides.

It is known that, in the preparation of such metals by electrolysis, the cathodic and anodic regions of the electrolysis bath must be separated in the electrolysing apparatus by means of a diaphragm.

The diaphragm must resist migration towards the anode of the ions of the metal which is to be deposited at the cathode. In fact, such ions, at least a proportion of which is present in degrees of ionisation which are lower than the maximum degree, would be oxidised to the higher level by the action of the halogen which is formed upon contact with the anode and which is also present in the atmosphere above the anolyte. Such a mechanism would result in a very substantial drop in the electrolysis efficiency.

On the other hand, the diaphragm must permit the alkali or alkaline earth ions and also the halogen ions which provide for carrying the greater part of the current, to pass.

Generally, the permeability of the diaphragm must be sufficient to permit circulation of the electrolyte in order to balance the pressures in the two compartments, while forming the maximum obstacle to migration of the metal to be deposited, whether in an ion form or not, towards the anodic compartment.

U.S. Pat. No. 2,789,943 describes in particular a process for producing titanium by electrolysis of a bath of molten halides, in which a perforated metal structure is interposed between the anode and the cathode so as to separate the anolyte and the catolyte.

This structure preferably comprises a perforated screen or grid of nickel or nickel-base alloy. So that it has a sufficiently low degree of permeability for it to act as a diaphragm, it is covered with an electrolytic deposit of titanium in the electrolysis cell itself. For that purpose, said structure is connected to the electrical supply circuit of the cell, so that it acts as a cathode. The titanium deposit which is then formed partially blocks the holes therein.

When the permeability of the structure has been sufficiently reduced, normal electrolysis conditions are established, between the anode and the cathode, and the structure bearing its resulting coating of titanium acts as an effective diaphragm.

French Pat. No. 2,423,555 describes another diaphragm construction for cells used for the electrolytic preparation of polyvalent metals. The diaphragms preferably comprise a nickel gauze on which an electrolytic or non-electrolytic deposit of cobalt has been produced.

The use of these two types of diaphragm has shown however that they do not allow the problems which occur to be entirely overcome.

In fact, it is found that, irrespective of the constituent material of the diaphragm, a deposit of the polyvalent metal present in the bath in halide form is formed on the diaphragm in the course of the electrolysis process. The formation of such a deposit is promoted when, as taught in U.S. Pat. No. 2,789,943, the diaphragm is electrically connected to the supply circuit of the cell so that it is of negative polarity with respect to the anode. However, even when the diaphragm is insulated, it is found that deposits of the polyvalent metal are formed at least in certain regions of the diaphragm.

Experience has shown that these deposits are formed in particular in the vicinity of or in the interior of the holes or channels which form a communication between the two faces of the diaphragm.

Thus, a progressive reduction in the permeability of the diaphragm is found in most cases, in the course of operation of the electrolysis cell.

Such a reduction is initially accompanied by an improvement in the electrolysis current efficiency, which can reach 80% and even higher, as shown in French Pat. No. 2,423,555.

Unfortunately, this high level of efficiency is not maintained for a prolonged period and gradually, as the electrolysis process continues, it is found on the one hand that there is a rise in the voltage at the terminals of the cell, and on the other hand, a drop in the current efficiency. This phenomenon is due to the pores of the diaphragm being virtually totally blocked by the polyvalent metal.

The connection between the anolyte and the catholyte is progressively cut and the diaphragm begins to function as a bipolar electrode. In most cases, this results in the diaphragm being destroyed, either due to corrosion or due to its being crushed.

A process has therefore been sought, which makes it possible to overcome such disadvantages and in particular considerably to extend the service life of the diaphragms used for preparation of polyvalent metals by electrolysis.

Such a process must also make it possible to maintain a high level of current efficiency, both as regards the deposit of polyvalent metal at the cathode and as regards halogen being liberated at the anode. Finally, it must make it possible to maintain the voltage at the terminals of the electrolysis cell within given limits corresponding to operating conditions which are close to the optimum.

The process which is the subject to this invention comprises controlling the permeability of the diaphragm of an electrolysis cell for the preparation of polyvalent metals such as Ti, Zr, Hf, V, Nb and Ta, by virtue of the formation of a deposit of the metal to be produced on the diaphragm, and maintaining said permeability at an optimum value by controlling the growth or partial re-dissolution of said deposit in dependence on the voltage drop in the electrolyte impregnating the diaphragm or a value linked to said voltage drop so as to maintain it within given limits.

The growth or partial re-dissolution of a deposit of a polyvalent metal, as referred to above, is effected without interrupting the electrolysis process, continuously or discontinuously, at a constant or variable speed.

A particularly advantageous method of controlling the permeability of the diaphragm according to the invention comprises passing an electrical current into the diaphragm in one direction or the other so that there is either growth of the deposit of the polyvalent metal on the diaphragm or re-dissolution of such deposit, the direction and intensity of said current being dependent on the variation in the voltage drop in the electrolyte impregnating the diaphragm.

The examples and the accompanying drawings illustrate in greater detail the features of the process according to the invention and the main embodiments thereof.

Figure 2:
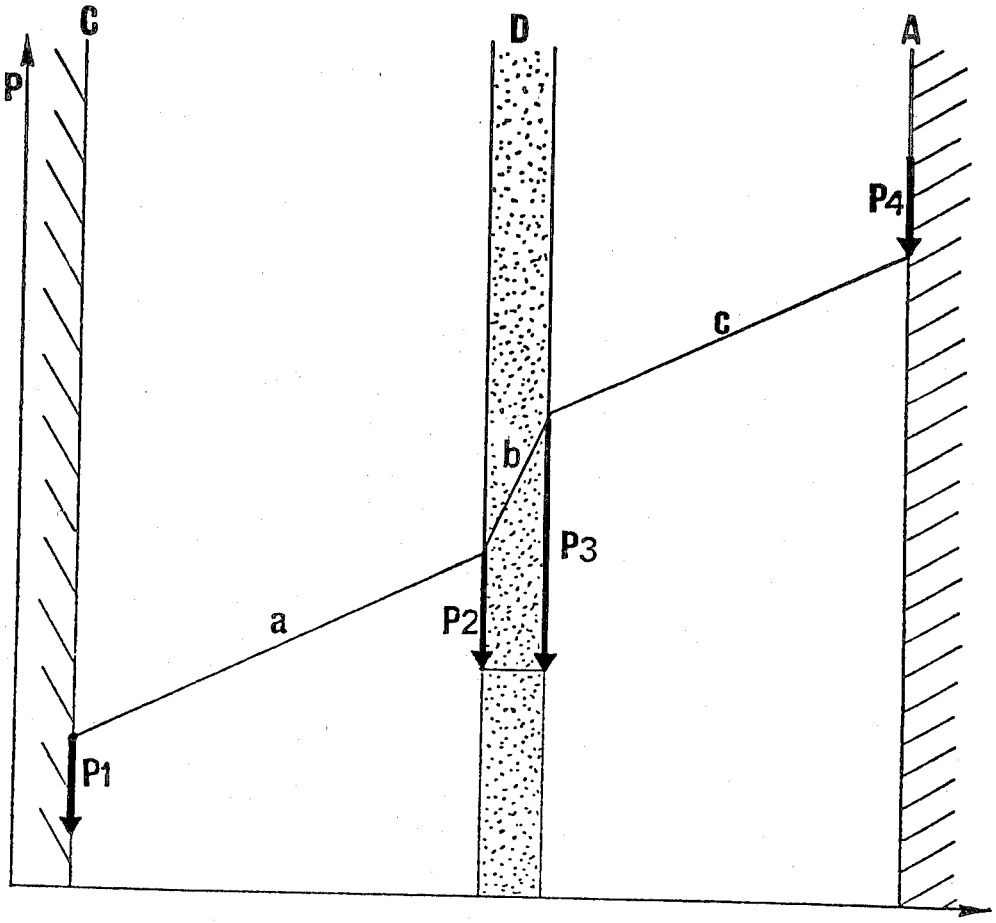
Figure 3:
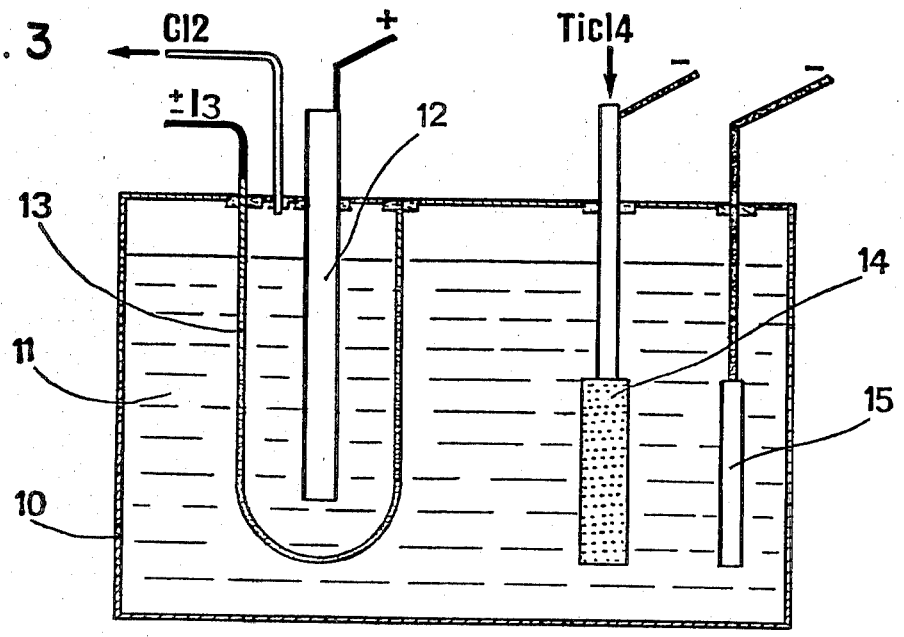

FIG. 1 is a diagrammatic view of a diaphragm-type electrolysis cell for the preparation of a polyvalent metal such as titanium, FIG. 2 is a diagram showing the distribution of potentials in a diaphragm cell of the type shown in FIG. 1, which is used for the electrolytic preparation of titanium from an electrolyte based on molten chlorides, and FIG. 3 is a diagrammatic view of an embodiment of the process according to the invention as applied to a diaphragm electrolysis cell of the type shown in FIG. 1.

Although the example hereinafter is more particularly concerned with the preparation of titanium, the process can also be applied to the production of other polyvalent metals such as in particular Zr, Hf, V, Nb and Ta.

FIG. 1 is a diagrammatic view of a diaphragm-type electrolysis cell which is suitable in particular for the preparation of titanium by electrolysis, the general arrangement of which is similar to that described in USBM Report No 7648-1972 entitled 'Use of composite diaphragm in Electrowinning of titanium' (FIG. 1, page 3).

The cell comprises a container 1 of refractory steel which is heated from the outside by known means (not described) for raising the electrolyte 2 to a temperature of about 550° C. The electrolyte comprises a eutectic mixture LiClKCl containing titanium in solution, in the form of chlorides, in a concentration of from about 1 to 3% by weight of Ti.

A graphite anode 3 is immersed in the electrolyte and is surrounded by a diaphragm 4. The anode 3 is connected by a rod 5 to the positive terminal of a current source (not shown). A feed cathode comprises a tube 6 of mild steel, which is connected to the negative terminal of a current source (not shown). The cathode is supplied with $TiCl_4$ by way of the connecting pipe 7 from an injection system (not shown). The end of the tube 6 has a perforated region 8 which is also of mild steel and is immersed in the electrolyte.

Finally, a mild steel deposit cathode 9 is also connected to the negative terminal of the current source. A current distributing device (not shown) makes it possible to fix the ratio between the current $I_1$ and $I_2$ which respectively pass through the feed cathode 6 and the deposit cathode 9. The intensity of the current which passes through the anode is equal to $I_1+I_2$.

The diaphragm 4 is in the form of a Ni grid which has been coated with a Ti deposit by a suitable method such as that described in U.S. Pat. No. 2,789,943 so as to reduce the permeability thereof to the desired level.

The amount of $TiCl_4$ injected through the feed cathode is such that the concentration of Ti dissolved in the electrolyte is preferably maintained in the concentration range of from 1 to 3% by weight of Ti.

For a cathodic deposit efficiency level of 100%, the amount of $TiCl_4$ introduced in grams per hour, for an electrolysis current of I (amperes) is $1.772\times I$.

Although the nature of the titanium ions present in the catholyte is not precisely known, the situation is as if, under those conditions, the titanium were present in the form of divalent ions, in regard to the majority part thereof.

As explained hereinbefore, when the diaphragm is insulated from the circuit for supplying the cell with electrical current, it is found that, as the electrolysis operation progresses, the diaphragm becomes blocked, that is to say, a deposit of titanium is formed, which closes the pores in the diaphragm.

The diagram shown in FIG. 2 illustrates the distribution of the potentials in the electrolysis cell during operation thereof. In FIG. 2, the ordinates show the potential P in the electrolysis cell, versus the distance between the cathode and the anode which is shown in abscissae. The cathode C, the diaphragm D and the anode A are shown in diagrammatic fashion.

The straight line portions a, b and c respectively show the variations in potential which occur in the catolyte, in the electrolyte which impregnates the diaphragm, and in the anolyte. Finally, the vertical vectors $P_1$, $P_2$, $P_3$ and $P_4$ respectively show the differences in potential between the cathode, the cathodic and anodic faces of the diaphragm, and the anode, with respect to the electrolyte in contact therewith.

Across the diaphragm, the variation in potential 'b' is equal to the product of I (electrolysis current) by $R_D$ (resistance of the electrolyte impregnating the diaphragm). $I\times R_D$ varies inversely to permeability.

Studies carried out by the applicant have shown that the diaphragm which is covered with titanium over its major part tends to behave like a titanium electrode with respect to the electrolyte, and that it is constantly in a condition of equilibrium in respect of potential, relative to the electrolyte. At the cathodic side, the equilibrium potential $P_2$ is defined by the formula which is well known to electro-chemists:

$$P_2 = e_o^{Ti2+/Tio} + \frac{RT}{2F} \ln \text{cathodic } a^{Ti2+}$$

In the above formula:

$$e_o^{Ti2+/Tio}$$

represents the normal potential corresponding to the chemical reaction:

$$Ti \rightarrow Ti^{2+} + 2e$$

cathodic $a^{Ti2+}$ represents the activity of the $^{Ti2+}$ ions in the catolyte.

At the anodic side, the equilibrium potential of the diaphragm, $P_3$, with respect to the anolyte, is defined by the following formula:

$$P_3 = e_o^{Ti2+/Tio} + \frac{RT}{2F} \ln \text{anodic } a^{Ti2+}$$

In the above formula, the conventions are the same as in the previous formula, and anodic $a^{Ti2+}$ represents the activity $a^{Ti2+}$ ions in the anolyte.

In normal operation and at a given moment, because of the high level of electronic conductivity of the material forming the diaphragm, we have:

$$e_o^{Ti2+/Tio} + \frac{RT}{2F} \ln \text{cathodic } a^{Ti2+} - IR_D =$$

-continued $$e_o^{Ti2+/Tio} + \frac{RT}{2F} \ln \text{anodic } a^{Ti2+}$$

Any variation in cathodic $a^{Ti2+}$ automatically results in the condition of equilibrium being re-established and therefore a variation in $$\text{anodic } a^{Ti2+}$$

by dissolution or deposit of metallic titanium in the pores of the diaphragm.

Simplifying relationship No. 1 gives:

$$\frac{RT}{2F} \ln \frac{\text{cathodic } a^{Ti2+}}{\text{anodic } a^{Ti2+}} = IR_D$$

$IR_D$ is therefore a measurement in respect of the efficiency of the diagram in acting as a means for preventing the diffusion of the titanium ions towards the anolyte.

In the course of the electrolysis process, it is generally found that there is a reduction in the porosity of the diaphragm and therefore a progressive increase in $IR_D$, which is initially favourable to the level of output. However, there is a limit which is defined by the equality:

$$e_o^{Ti2+/Tio} + \frac{RT}{2F} \ln \text{cathodic } a^{Ti2+} - IR_D = e_o^{X+/Xo}$$

in which $e_o^{X+/Xo}$ represents the potential of deposit of the alkali or alkaline earth metal 'X' of the electrolyte, which is the easiest to deposit under the operating conditions involved.

Beyond that limit, the diaphragm becomes bipolar and an alkali or alkaline earth metal deposit appears on the face of the diaphragm facing the anode. The current efficiency at the anodic side then rapidly drops due to re-combination of the chlorine which is liberated at the anode, with the alkali metal formed. Moreover, on the other face of the diaphragm, chlorine ions are discharged, which cause the diaphragm to be rapidly attacked.

Likewise, an excessively high degree of permeability of the diaphragm is not desirable as diffusion of Ti ions from the catolyte towards the anolyte in an excessive amount would result in an excessive drop in efficiency.

In order to overcome these disadvantages, the process for controlling the permeability of the diaphram according to the invention comprises controlling the deposit of titanium which is effected thereat more or less naturally either for the purposes of increasing it or for the purposes of partially re-dissolving it, said growth or said re-dissolution being controlled in dependence on the variation in the voltage drop across the electrolyte which impregnates the diaphragm. In this way it is possible, in an extremely simple manner, to pre-select a specific value in respect of the voltage drop, in dependence on the characteristics of the cell, and to maintain the voltage drop within a given range.

In practice, the voltage drop across the diaphragm must be kept below an upper limit, of the order of a volt, which corresponds to the difference between the $Ti^{2+}$ deposit potential and the deposit potential of the alkali or alkaline earth metal. Experience has shown that the level of efficiency improves in proportion as the voltage drop across the diaphragm approaches the above-mentioned upper limit, provided however that the level of permeability remains sufficient to ensure that the pressures in the two compartments are balanced.

It is possible to measure the value which is very close to the above-mentioned voltage drop, by arranging two reference electrodes on respective sides of the diaphragm and in the immediate vicinity thereof but without being in contact therewith, for example electrodes which are sensitive to Cl ions such as Ag/AgCl electrodes, one of the electrodes being immersed in the catholyte and the other being immersed in the anolyte and the electrodes being connected to a voltmeter of high internal resistance. Operation of the diaphragm permeability controlling apparatus will be controlled, in a manner well known to the man skilled in the art, in dependence on the variations in the voltage drop indicated by the voltmeter, so as to maintain it within the desired limits. It is also possible much more easily to provide for continuous measurement of the potential difference between the diaphragm and the anode, by means of a voltmeter of the same type, and to compare that potential difference to a reference potential which in most cases will be that which will have been measured in the period subsequent to the diaphragm being put into service, in which period the permeability thereof was considered as having attained a satisfactory level. The growth or re-dissolution of the deposit of titanium in the pores of the diaphragm will then only have to be controlled in dependence on the variations in the difference between the measured voltage and the reference voltage.

At any event, that difference should not exceed the value which would correspond to discharge of the alkali ions on the diaphragm.

Other measuring means, either for measuring directly the voltage drop across the electrolyte which impregnates the diaphragm, or for measuring a variable dependent on that voltage drop, may be envisaged.

A particularly advantageous apparatus which is shown in FIG. 3 comprises connecting the diaphragm to a current source which is capable of causing the current to flow in both directions, the other terminal of the current source being connected to the cathode.

As will be seen, FIG. 3 is a diagrammatic view of an electrolysis cell, the design of which derives from that of the cell shown in FIG. 1.

The metal electrolysis cell 10 contains the electrolyte 11, the composition of which is similar to the composition of the electrolyte described hereinbefore, for the preparation of titanium.

The anode 12 is surrounded by a diaphragm 13.

As usual, the anode is connected to the positive terminal of a first current source (not shown), the negative terminal of which is connected to the cathodes. The diaphragm is connected either to the positive terminal or to the negative terminal of a second current source (not shown), the other terminal of which is connected to the cathode, and which is capable of causing a current $I_3$ to flow through the diaphragm in the desired direction.

The $TiCl_4$ feed cathode 14 and the deposit cathode 15 are similar to those already described with reference to FIG. 1.

It is thus possible for a current $I_3$ to be injected through the diaphragm, which passing through the catholyte, is deducted from or added to the current I from the anode. Depending on its direction of flow, the current $I_3$ causes the deposit or re-dissolution of titanium on the diaphragm and thus makes it possible for the permeability of the diaphragm to be set to and maintained at its optimum value.

A device which is known to the man skilled in the art provides for controlling the direction and the intensity $I_3$ of the current injected into the diaphragm, in dependence on the variation in the voltage drop $IR_D$ through the electrolyte impregnating the diaphragm, such variation being detected by one of the above-described means and for example by continuously measuring the potential difference between the diaphragm and the anode. The injection of current $I_3$ through the diaphragm is begun as soon as the voltage drop across the electrolyte impregnating the diaphragm deviates from the reference voltage in one direction or the other. The dependent control effect makes it possible for the current $I_3$ injected in the desired direction to be increased in intensity in proportion to an increasing difference between the voltage drop across the electrolyte impregnating the diaphragm, and the reference voltage. The arrangement is such that the procedure is self-regulating, that is to say, so that the increase in the intensity of the current in dependence on the voltage difference is greater than the value which is strictly necessary, in order to accelerate deposit or dissolution and as far as possible to promote a return to normal conditions in regard to diaphragm permeability.

The current $I_3$ may possibly be taken off in parallel from the current source which supplies the cell, independent reversing and regulating means providing for control of that current in respect of direction and intensity, in dependence on the variations in the voltage drop in the electrolyte impregnating the diaphragm, as explained above.

The means for controlling the permeability of the diaphragm according to the invention, as just described above, may be used not only in relation to titanium but also in relation to the production of other polyvalent metals by electrolysis, such as zirconium, hafnium, vanadium, niobium or tantalum.

Many variations may be made in the embodiment of the diaphragm permeability control process, without thereby departing from the scope of the invention.

I claim:

1. A process for controlling the permeability of the diaphragm of an electrolysis cell for the preparation of a metal selected from the group consisting of Ti, Zr, Hf, V, Nb and Ta, from an electrolyte based on molten metal halides, the diaphragm being coated with a deposit of the metal to be produced, characterised in that said control is provided by a deposit growth or re-dissolution process which is controlled in dependence on the voltage drop in the electrolyte impregnating the diaphragm, or a measured variable linked to said voltage drop.

2. A process according to claim 1 characterised in that the growth or re-dissolution process comprises injecting a continuous current into the diaphragm, the intensity and the direction of said current being controlled in dependence on the voltage drop in the electrolyte impregnating the diaphragm or a measured variable linked to said voltage drop.

3. A process according to claim 2 characterised in that, in the case of electrolysis of titanium, the measured variable is the potential difference between two reference electrodes immersed in the electrolyte on respective sides of the diaphragm.

4. A process according to claim 1 or 2 characterised in that the measured variable is the potential difference between the anode and the diaphragm.

5. An electrolysis cell for the production of a polyvalent metal comprising an anode, a feed cathode, and a deposit cathode, a diaphragm surrounding the anode and coated with a deposit of the polyvalent metal to be produced, and means for controlling the permeability of the diaphragm by depositing or dissolving polyvalent metal coating on the diaphragm in response to a voltage drop in an electrolyte impregnating the diaphragm, said controlling means comprising two reference electrodes positioned on respective sides of the diaphragm, which electrodes are connected to means for measuring their electrical potential difference.

* * * * *